US007911437B1

(12) United States Patent
Bell

(10) Patent No.: US 7,911,437 B1
(45) Date of Patent: Mar. 22, 2011

(54) STACKED AMPLIFIER WITH CHARGE SHARING

(75) Inventor: Marshall J. Bell, Chandler, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 952 days.

(21) Appl. No.: 11/580,517

(22) Filed: Oct. 13, 2006

(51) Int. Cl.
*G09G 3/36* (2006.01)
*G09G 5/00* (2006.01)

(52) U.S. Cl. ..... 345/100; 345/210

(58) Field of Classification Search ..... 345/87, 345/100, 210, 211
See application file for complete search history.

(56) References Cited

U.S. PATENT DOCUMENTS

| | | | | |
|---|---|---|---|---|
| 5,528,256 | A | 6/1996 | Erhart et al. | 345/96 |
| 5,852,426 | A | 12/1998 | Erhart et al. | 345/96 |
| 6,549,186 | B1 | 4/2003 | Kwon | 345/95 |
| 6,954,201 | B1 | 10/2005 | Ludden et al. | 345/204 |
| 6,970,152 | B1 * | 11/2005 | Bell et al. | 345/100 |
| 2006/0164374 | A1 * | 7/2006 | Chang et al. | 345/100 |
| 2008/0278427 | A1 * | 11/2008 | Jang et al. | 345/98 |

OTHER PUBLICATIONS

"PPDS Technology—Next-Generation Interface for LCD TV," www.national.com, *National Semiconductor Corporation*, 2006, 3 pgs.
Richard I. McCartney et al., 60.1 A Third Generation Timing Controller and Column Driver Architecture Using Point-to-Point Differential Signaling, *Society for Information Display SID Digest* May 25, 2004, 4 pgs.
"Using Smart Charge Sharing to Reduce Power and Boost column Driver Performance," www.national.com, *2002 National Semiconductor Corporation*, pp. 1-4.

* cited by examiner

*Primary Examiner* — Amr Awad
*Assistant Examiner* — Randal Willis

(57) ABSTRACT

Column drivers for graphics displays can be arranged as stacked amplifiers with various switching circuits arranged in a charge sharing topology. The apparatus includes an upper and lower amplifier circuit, an input switching circuit, and an output switching circuit. The upper and lower amplifier circuits drive column lines can be swapped during operation by the input and output switching circuits. During a charge share operation, the outputs of the amplifiers are coupled to a common voltage via the output switching circuit, while the transistors from the output stage of each amplifier is reconfigured for charge sharing. Minimally sized transistors are utilized inside the output stage of the amplifiers for charge share configuration. Since the existing transistors from the output stage are utilized for the charge sharing operation, additional space savings and power reductions can be realized.

23 Claims, 5 Drawing Sheets

STACKED AMPLIFIER WITH CHARGE SHARING

FIELD OF THE INVENTION

The present invention is generally related to column drivers for a graphics display. More particularly, the present invention relates to a column driver that includes stacked amplifiers with switching circuits coupled to their outputs, and arranged for improved performance with a charge sharing topology.

BACKGROUND

Graphics displays such as LCDs are organized according to rows and columns. A pixel in the LCD display is addressed by activating a column driver and a row selector. Separate buffer amplifiers (column drivers) are employed to drive each respective column of the LCD. Thus, a typical LCD requires hundreds of buffer amplifiers to drive all of the columns in the display. Each of the buffer amplifiers is generally required to drive a rail-to-rail signal to the respective one of the columns in the LCD.

Color LCDs typically include multiple color planes (e.g., RGB). Each pixel address typically includes a separate pixel for each color plane. Pixels in the LCD are arranged as charge storage elements that are represented as capacitors. Each row selector operates as a switch that couples the output of a column driver to pixel in the LCD array. The charge stored in the pixel is an analog quantity that determines the brightness associated with the pixel. For color pixel arrays, the color associated with a selected pixel is determined by the charge stored in each of the pixels associated with the color planes. A typical color LCD also requires hundreds of buffer amplifiers to drive all of the columns in the display.

Pixels in the LCD are susceptible to damage when a DC voltage is maintained across the LCD for long periods of time. The liquid crystal damage is a result of charge migration across the liquid crystal, possibly de-ionizing the material. The result of the charge migration is that the LCD material will stick to the surfaces and cause image retention issues such as a sticking image. To prevent damaging the LCD material, the polarity of the signal applied to the LCD pixel is periodically reversed, typically every frame. An example LCD display system uses an alternating pixel pattern referred to as pixel inversion. In a pixel inversion system, each LCD column must be operated about a common voltage such that the output for each odd column is operated in an opposite range (e.g., from VDD to VDD/2) as the output for the even columns (e.g., from VDD/2 to VSS).

A liquid crystal display (LCD) system is illustrated in FIG. 1A. The LCD display system includes an LCD array that is organized according to rows and columns. A timing and control block receives video data and generates the necessary timing signals to selectively activate pixels in the LCD system. The timing and control signals activate a pixel by enabling a column driver and a row selector. Thin film transistor (TFT) type displays have a transistor array that is placed on top of liquid crystal array to operate as the row selectors.

The column drivers from FIG. 1A can be arranged as part of a charge share topology with the addition of extra switching circuits and capacitors as illustrated by FIG. 1B. N column drivers (DRV1-DRVN) include corresponding inputs IN1 through INN and outputs that are connected to column lines 1 through N. An array of switches (S1-SN) is used to connect all of the outputs of the column drivers. For example, just prior to the columns switching between voltage ranges (e.g., many LCD displays use line inversion, and often larger sized displays use pixel inversion) the switches are activated to couple the column outputs together to a charge storage capacitor (CSTORE).

BRIEF DESCRIPTION OF THE DRAWINGS

Non-limiting and non-exhaustive embodiments are described with reference to the following drawings.

DETAILED DESCRIPTION

Figure 1A:
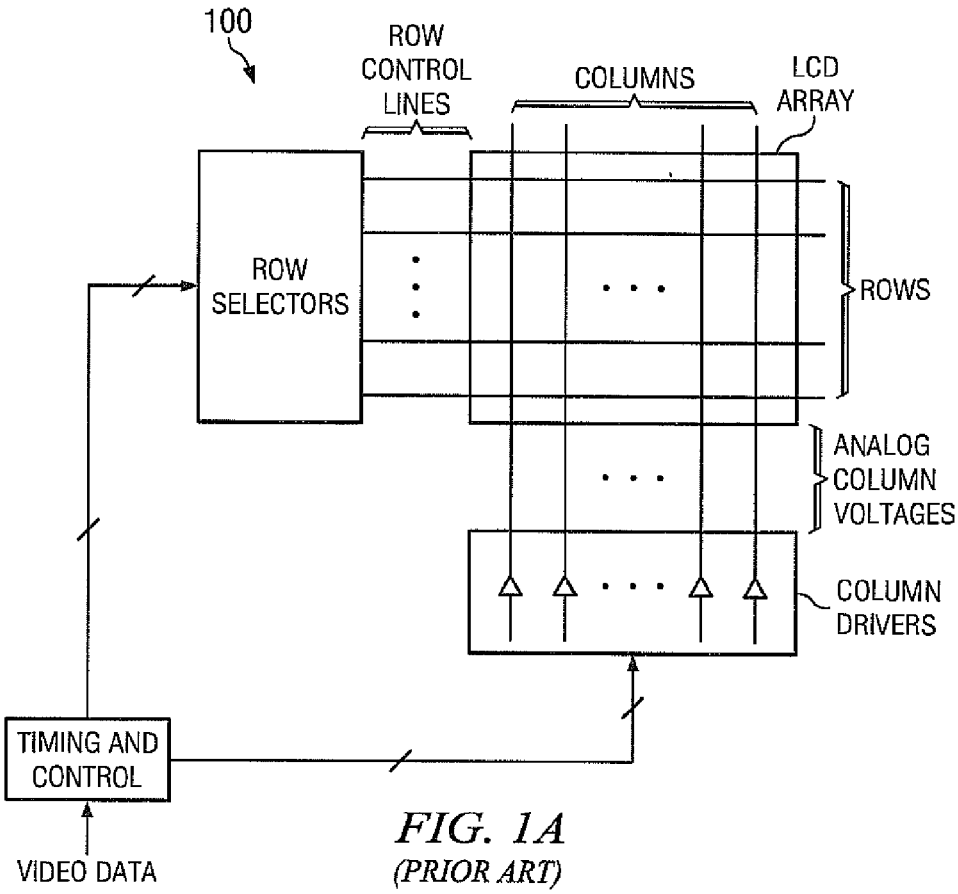
FIG. 1A (PRIOR ART)
FIGS. 1A and 1B are schematic diagrams for a conventional LCD system.
Figure 1B:
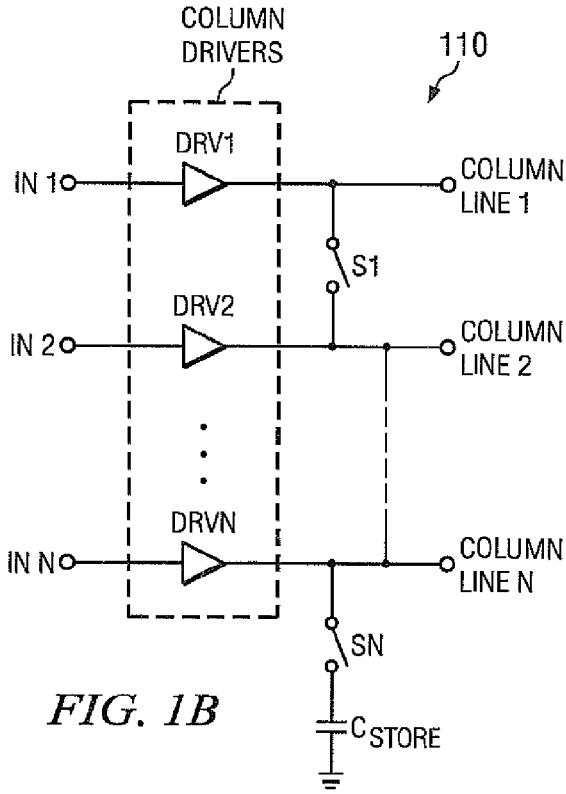

Various embodiments will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context clearly dictates otherwise. The meanings identified below are not intended to limit the terms, but merely provide illustrative examples for use of the terms. The meaning of "a," "an," and "the" may include reference to both the singular and the plural. The meaning of "in" may include "in" and "on." The term "connected" may mean a direct electrical, electro-magnetic, mechanical, logical, or other connection between the items connected, without any electrical, mechanical, logical or other intermediary therebetween. The term "coupled" can mean a direct connection between items, an indirect connection through one or more intermediaries, or communication between items in a manner that may not constitute a connection. The term "circuit" can mean a single component or a plurality of components, active and/or passive, discrete or integrated, that are coupled together to provide a desired function. The term "signal" can mean at least one current, voltage, charge, data, or other such identifiable quantity Briefly stated, the present disclosure generally relates to column drivers for a graphics display. Column drivers for graphics displays can be arranged as stacked amplifiers with various switching circuits arranged in a charge sharing topology. The apparatus includes an upper and lower amplifier circuit, an input switching circuit, and an output switching circuit. The upper and lower amplifier circuits drive column lines can be swapped during operation by the input and output switching circuits. During a charge share operation, the outputs of the amplifiers are coupled to a common voltage via the output switching circuit, while the transistors from the output stage of each amplifier is reconfigured for charge sharing. Minimally sized transistors are utilized inside the output stage of the amplifiers for charge share configuration. Since the existing transistors from the output stage are utilized for the charge sharing operation, additional space savings and power reductions can be realized.

Figure 2:
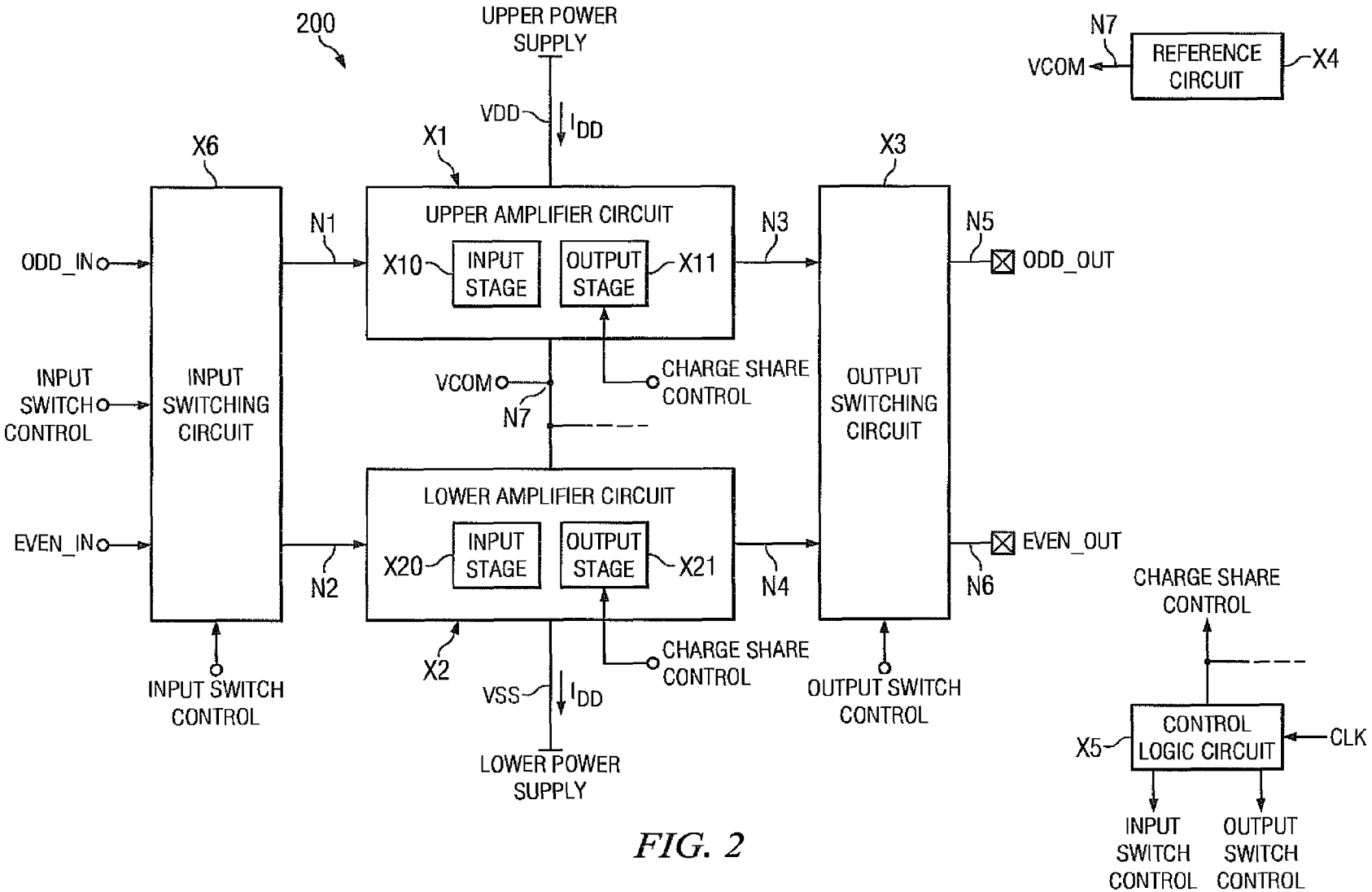
FIG. 2 is a schematic diagram of a stacked amplifier column driver circuit using a charge share topology arranged in accordance with at least an aspect of the present invention.

FIG. 2 is a schematic diagram of a stacked amplifier column driver circuit (200) using a charge share topology arranged in accordance with at least an aspect of the present invention. The stacked amplifier column driver circuit includes an upper amplifier circuit (X1), a lower amplifier circuit (X2), an input switching circuits (X6), an output switching circuit (X3), a reference circuit (X4), and a control logic circuit (X5). Circuit 200 can be configured as an integrated circuit where the various column line outputs (e.g., ODD_OUT and EVEN_OUT) can be coupled to bonding pads such that external connectivity to the column driver circuits is provided.

The upper amplifier circuit (X1) includes an input that is coupled to a first node (N1) and an output terminal that is coupled to a third node (N3). The lower amplifier circuit (X2) includes an input terminal that is coupled to a second node (N2) and an output terminal that is coupled to a fourth node (N4). The input switching circuit (X6) is coupled to an odd column input terminal (ODD_IN), an even column input terminal (EVEN_IN), the first node (N1), the second node (N2), and an input switch control signal. Output switching circuit X3 is coupled to an odd column line output terminal (ODD_OUT) at node N5, and even column line output terminal (EVEN_OUT) at node N6, the third node (N3), the fourth node, and an output switch control signal. The reference circuit (x4) is arranged to provide a common supply voltage (VCOM) at node N7. Various control signals can be provided by a control logic circuit (X5) that is responsive to an input control signal such as a from a clock signal (CLK).

The upper amplifier circuit (X1) also includes a high supply terminal that corresponds to VDD, and a low supply terminal that corresponds to VCOM. The lower amplifier circuit (X2) includes a high supply terminal that corresponds to VCOM, and a low supply terminal that corresponds to VSS. Both amplifier circuits X1 and X2 share a common supply level at node N7 that corresponds to VCOM. In one example, VSS corresponds to 0V and VCOM corresponds to VDD/2. In another example, VCOM corresponds to 0V and VDD and VSS are equidistant from 0V. Generally, VCOM can be designated as a middle supply voltage that such as [(VDD−VSS)/2+VSS].

Figure 3:
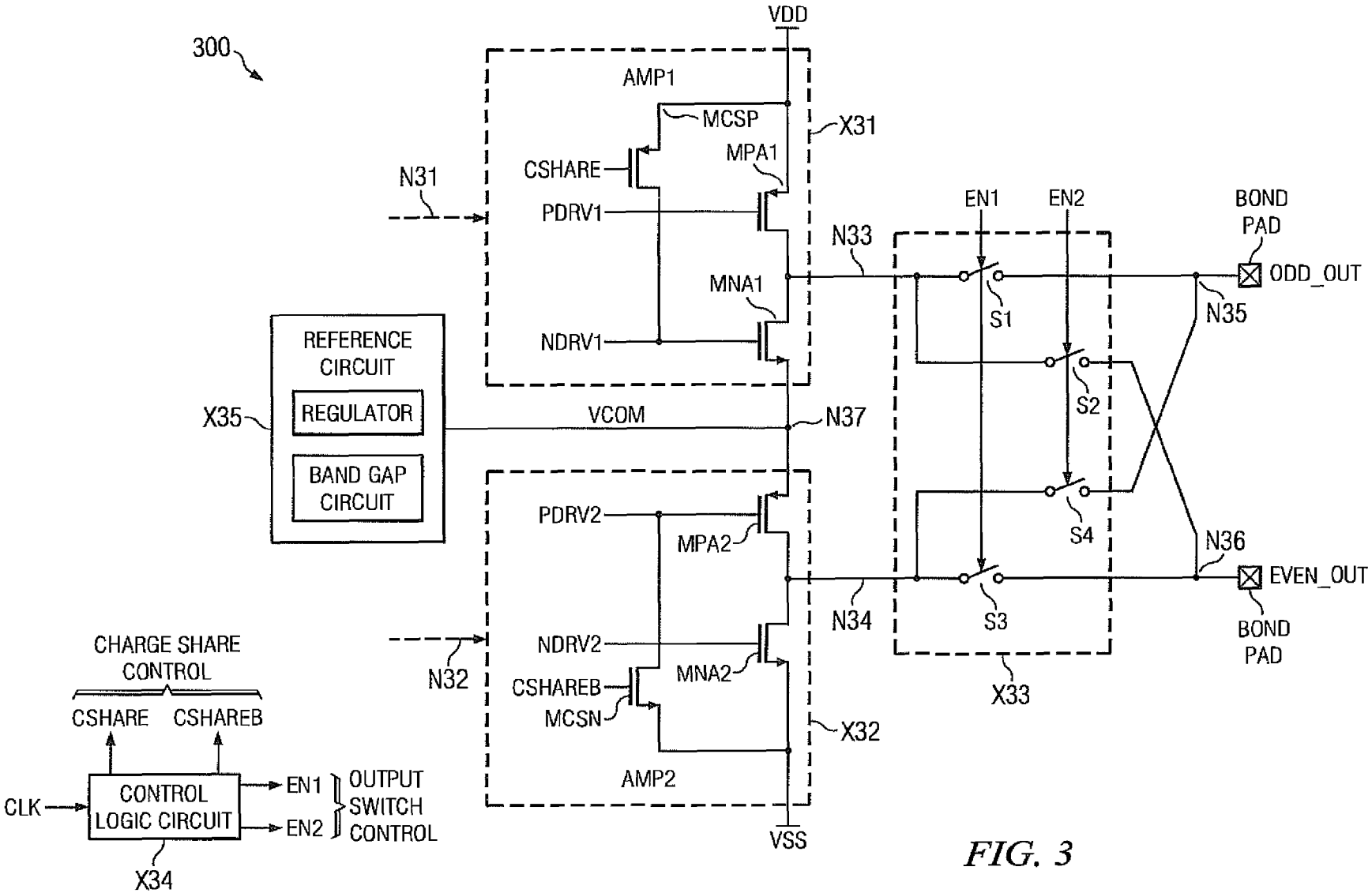
FIG. 3 is a schematic diagram of another stacked amplifier column driver circuit using a charge share topology arranged in accordance with still another aspect of the present invention.
Figure 4A:
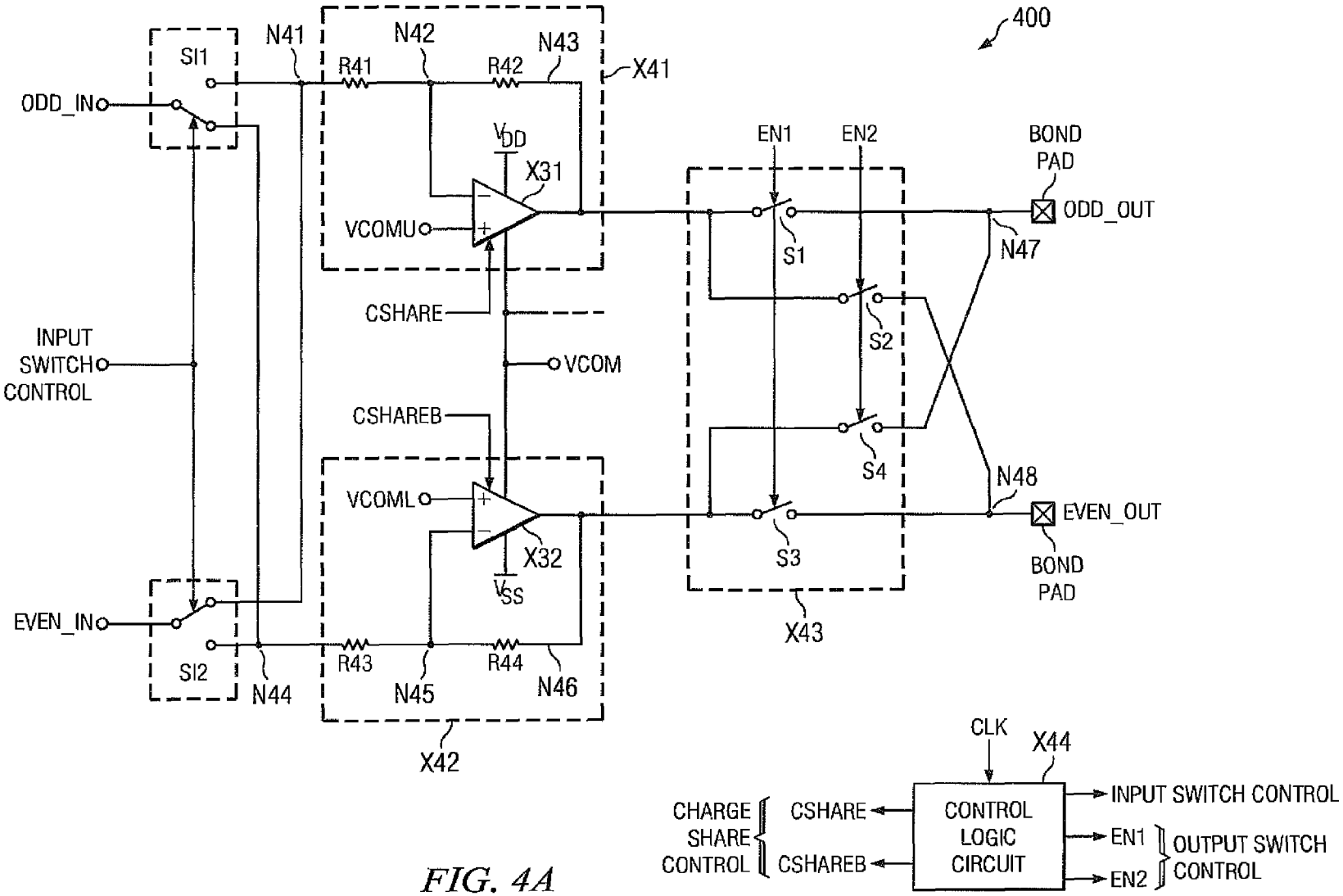
FIG. 4A is a schematic diagram of yet another stacked amplifier column driver circuit using a charge share topology arranged in accordance with yet another aspect of the present invention.

The input switching circuit (X6) is arranged to couple the odd input terminal (ODD_IN) to either node N1 or node N2 in response to the input switch control signal. An example implementation of the input switching circuit is further illustrated in FIG. 4A by switching circuits SI1 and SI2. The output switching circuit (X3) is arranged to selectively couple or decouple nodes N3 and N4 from the odd column line (ODD_OUT) at node N5 or the even column line (EVEN_OUT) at node N6 in response to the output switch control signal. An example implantation of the output switching circuit X3 that includes four switches (S1-S4) is illustrated in FIGS. 3 and 4A.

The upper amplifier circuit (X1) and the lower amplifier circuit (X2) each include a respective output stage (X11 and X21) that are configured for charge share operation via a charge share control signal that can be provided by the control logic circuit (X5). During charge share operation, the transistors in the output stages that are normally used for driving the output of the amplifier are configured to couple the common node (N7) to their respective outputs (N3 and N4). Since the transistors that are used for charge sharing in the output stages are pre-existing transistors from the output stage itself, minimal addition space is necessary for large transistors (e.g., on the order of 50 um in many processes) to implement the charge sharing topology. Die area is thus conserved as well as power consumption. See the discussion for FIG. 3 for an example implementation of the output stage.

Each of the amplifier circuits (X1, X2) operates over half of the total power supply range (e.g., VCOM-VDD and VSS-VCOM). The upper and lower amplifier circuits need not provide outputs levels that swing over the entire supply range (VSS through VDD). Each of the amplifier circuits can be optimized to operate over the limited supply range. For example, the differential input transistors in an input stage (X10) of the upper amplifier circuit (X1) can be implemented as n-type devices that operate over the upper supply range (VDD to VCOM), while the differential input transistors in an input stage (X20) of the lower amplifier circuit (X2) can be implemented as p-type devices that operate over the lower supply range (VCOM to VSS). The complexity of the amplifier circuits is simplified since the amplifiers need not operate over the full supply levels. Also, since the amplifier circuits only operate over half of the supply range, the amplifier circuits can employ devices (e.g., transistors, diodes, etc.) that have breakdown voltages that are less than the full supply voltage without the need for additional protection devices. Since additional protection devices would add parasitic capacitances to the circuits, additional protection devices would degrade the speed of the amplifier circuits.

An example display may have a resolution of 1024×768 pixels, requiring 1024 column driver amplifier circuits for a monochrome display, and 3072 column drives are required when there are three color planes. Since the number of column driver amplifier circuits is very large, any savings in power consumption for a column driver cell may have dramatic results in total power consumption. The limited range of operation for the amplifiers will result in a reduction in overall power that is consumed by each column drivers. The described charge sharing topology will further reduce power consumption. Also, since minimal additional devices are necessary in the output stage circuit of the amplifiers, the increase in die area for a large number of column drivers is also minimal.

FIG. 3 is a schematic diagram of another stacked amplifier column driver circuit (300) using a charge share topology arranged in accordance with still another aspect of the present invention. The stacked amplifier column driver circuit includes an upper amplifier circuit (AMP1, X31), a lower amplifier circuit (AMP2, X32), an output switching circuit (X33), a control logic circuit (X34), and an optional reference circuit (X35). Stacked amplifier column driver circuit 300 is similar in operation to stacked amplifier column driver circuit 200 from FIG. 2. Circuit 300 can be configured as an integrated circuit where ODD_OUT and EVEN_OUT can be coupled to bonding pads such that external connectivity to the column driver circuit is provided.

The upper amplifier circuit (X31) includes an input stage and an output stage. The output stage of the upper amplifier circuit (X31) is illustrated as transistors MCSP, MPA1 and MNA1. Transistors MCSP and MPA1 are p-type transistors, while transistor MNA1 is an n-type transistor. Transistor MCSP includes a gate that is coupled to the CSHARE control signal, a source that is coupled to the high power supply voltage (VDD), and a drain that is coupled to a first drive signal (NDRV1). Transistor MPA1 includes a gate that is coupled to a second drive signal (PDRV1), a source that is coupled to the high power supply voltage (VDD), and a drain that is coupled to the output of the upper amplifier at node N33. Transistor MNA1 includes a gate that is coupled to the first drive signal (NDRV1), a source that is coupled to the common voltage (VCOM) at node N37, and a drain that is coupled to the output of the upper amplifier at node N33.

The lower amplifier circuit (X32) also includes an input stage and an output stage. The output stage of the upper amplifier circuit (X32) is illustrated as transistors MCSN, MPA2 and MNA2. Transistor MPA2 is a p-type transistor, while transistors MCSN and MNA2 are n-type transistors. Transistor MCSN includes a gate that is coupled to the CSHAREB control signal, a source that is coupled to the low power supply voltage (VSS), and a drain that is coupled to a fourth drive signal (PDRV2). Transistor MPA2 includes a gate that is coupled to the fourth drive signal (PDRV2), a source that is coupled to the common voltage (VCOM) at node N37, and a drain that is coupled to the output of the lower amplifier at node N34. Transistor MNA2 includes a gate that is coupled to a third drive signal (NDRV2), a source that is coupled to the low power supply voltage (VSS), and a drain that is coupled to the output of the lower amplifier at node N34.

Transistors MPA1 and MNA1 are arranged in a push-pull configuration that is responsive to drive signals PDRV1 and NDRV1 to drive a common output at node N33 such that the upper amplifier is providing amplification in a non-charge sharing operational state. Similarly, transistors MPA2 and MNA2 are arranged in a push-pull configuration that is responsive to drive signals PDRV2 and NDRV2 to drive a common output at node N34 when the lower amplifier is providing amplification in a non-charge sharing operational state. These drive signals (PDRV1, NDRV1; and PDRV2, NDRV2) are provided by a preceding stage of the amplifier to the output stage. For example, in a folded cascade design, the input stage is arranged to activate high impedance current sources that drive the output stage.

The output switching circuit (X33) includes four switches (S1-S4). Switches S1 and S3 are activated in response to control signal EN1 to couple node N33 to node N35 via switch S1, and also couple node N34 to node N35 via switch S3. Switches S2 and S4 are activated in response to control signal EN2 to couple node N33 to node N36 via switch S2, and also couple node N34 to node N35 via switch S4. Each of the switches can be implemented as a single transistor, two transistors arranged as a transmission gate, or any other transistor based switching circuit as will be understood to those of skill in the art.

Charge sharing is accomplished by actuation of the output switching circuit (X33) together with the operation of transistors MCSP and MCSN in the output stage of the amplifier circuits. When transistor MCSP is activated in response to control signal CSHARE, transistor MNA1 is activated and node N37 is effectively coupled to node N33. Similarly, when transistor MCSN is activated in response to control signal CSHAREB, transistor MPA2 is activated and node N37 is effectively coupled to node N34. Switching circuits X33 and X34 are operated in a closed circuit position during charge sharing such that nodes N33, N34, N35 and N36 are also coupled together to node N37. Since all of the amplifier circuits in the driver array share a common connection to node N37, the switching arrangement provides effective charge sharing with the addition of minimal components.

Transistors MCSP and MCSN can be small switching transistors (e.g., on the order of 1 um in width for an example MOS device) since they don't conduct a significant amount of current (the current in the driver is provided by transistors MPA1, MNA1, MPA2 and MNA2). In contrast, the switching transistors used in conventional charge share circuits are external to the amplifiers, conduct a larger amount of current, and are larger in size (e.g., on the order of 50 um in width for an example MOS device) since the on-resistance needs to be relatively low. The area savings can be quite significant since a large number of output devices may be required for an example column driver array (e.g. in excess of 100 drivers in many applications). Also, the conventional charge share circuits present a significant capacitive load on their control signals since the gate area for these switching devices is increased to provide a nominally low on-resistance. In contrast, transistors MCSP and MCSN are very small devices that don't provide a significant capacitive load on the control signals (CSHARE, CSHAREB). The reduced drive requirements for MCSP and MCSN further reduced power consumption.

The control logic circuit (X34) is arranged to provide the various control signals that are necessary for charge sharing, as well as any other output swapping functions that are necessary during amplification. The charge share control signals in this example are comprised of signals CSHARE and CSHAREB, which are simply inversely related to one another. The output switch control signals in this example are comprised of signals EN1 and EN2. During amplification, either signal EN1 is asserted or signal EN2 is asserted such that nodes N33 and N34 are not shorted together. However, during charge share operation both signals EN1 and EN2 are asserted so that nodes N33 and N34 are effectively shorted together through the output switching circuit (X33).

The optional reference circuit (X35) is arranged to provide a reference voltage (VCOM) at node N37. The reference voltage can be provided as a temperature compensated voltage such as by a bandgap circuit, or a non-temperature compensated voltage. The reference voltage is provided from a voltage source that can either be an on-chip voltage generator or an off-chip voltage generator (e.g., a voltage regulator). In a common application, the reference voltage can be provided by a voltage divider circuit and a buffer, similar to that described with reference to FIG. 4B.

FIG. 4A is a schematic diagram of yet another stacked amplifier column driver circuit (400) using a charge share topology arranged in accordance with yet another aspect of the present invention. The stacked amplifier column driver circuit includes an upper amplifier circuit (X41), a lower amplifier circuit (X42), two input switching circuits (SI1, SI1), and an output switching circuits (X43). Stacked amplifier column driver circuit 400 is similar in operation to stacked amplifier column driver circuit 200 from FIG. 3, where the amplifier circuits are arranged as an inverting amplifier circuit. Circuit 400 can be configured as an integrated circuit where ODD_OUT and EVEN OUT can be coupled to bonding pads such that external connectivity to the column driver circuit is provided.

Similar to the schematic illustrated in FIG. 3, the upper amplifier circuit (X41) includes a high supply terminal that corresponds to VDD, and a low supply terminal that corresponds to VCOM. The lower amplifier circuit (X32) includes a high supply terminal that corresponds to VCOM, and a low supply terminal that corresponds to VSS.

Amplifier circuit X41 includes an operation amplifier circuit (X31) and two resistors (R41, R42), and is arranged to operate as an inverting amplifier circuit that has a gain that is determined by a first feedback network (e.g., resistors R41 and R42). The upper amplifier circuit (X41) also includes an upper common voltage (VCOMU) that is typically a middle-supply for the range from VCOM to VDD. In other words, VCOMU is determined by VCOM and VDD as: VCOMU=VCOM+(VDD−VCOM)/2. In operation, the inverting input of amplifier circuit X41 will have the same DC level as the non-inverting input such that the DC voltage at node N42 will be VCOMU. Amplifier X41 need not operate over a rail-to-rail input range when configured as an inverting amplifier, and instead has a limited operating range that is centered on VCOMU. Operation amplifier circuit X31 includes an output stage circuit as that previously described for FIG. 3, which is responsive to the control signal CSHARE.

Amplifier circuit X42 includes an operation amplifier circuit (X32) and two resistors (R43 and R44), and is arranged to operate as an inverting amplifier circuit that has a gain that is determined by a second feedback network (e.g., resistors R43 and R44). The lower amplifier circuit (X42) also includes a lower common voltage (VCOML) that is typically a middle-supply for the range from VSS to VCOM. In other words, VCOML is determined by VCOM and VSS as: VCOML=VSS+(VCOM−VSS)/2. In operation, the inverting input of amplifier circuit X42 will have the same DC level as the non-inverting input such that the DC voltage at node N45 will be VCOML. Amplifier X42 need not operate over a rail-to-rail input range when configured as an inverting amplifier, and instead has a limited operating range that is centered on VCOML. Operation amplifier circuit X32 also includes an output stage circuit as that previously described for FIG. 3, which is responsive to the control signal CSHAREB.

The control logic circuit (X44) is arranged to provide the various control signals that are necessary for charge sharing, as well as any other input or output swapping functions that are necessary during amplification. The charge share control signals in this example are comprised of signals CSHARE and CSHAREB, which are simply inversely related to one another. The output switch control signals in this example are comprised of signals EN1 and EN2. During amplification, either signal EN1 is asserted or signal EN2 is asserted such that nodes N33 and N34 are not shorted together. Also during amplification, the input switch control signal is arranged to swap the input signals (ODD_IN and EVEN_IN) relative to nodes N41 and N44 to match the swapping operation of the output switch control circuit (X43). However, during charge share operation both signals EN1 and EN2 are asserted so that nodes N33 and N34 are effectively shorted together through the output switching circuit (X33).

Figure 4B:
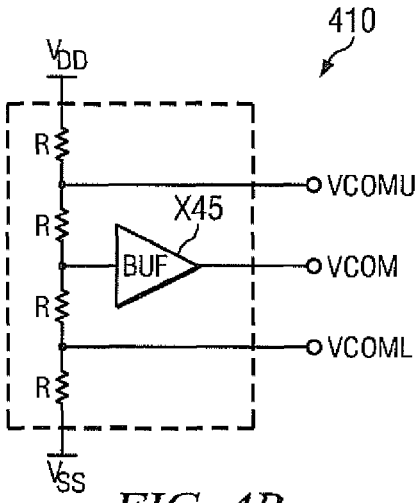
FIG. 4B is a schematic diagram of a common voltage reference generator that may be employed by a stacked amplifier column driver circuit that is arranged in accordance with at least some aspect of the present invention.

FIG. 4B is a schematic diagram of a common voltage reference generator (410) that may be employed by a stacked amplifier column driver circuit (e.g., 200, 300 and 400) that is arranged in accordance with at least some aspect of the present invention. The voltage reference includes four equal value resistors (R) and a buffer circuit (X45). The resistors (R) are arranged as a voltage divider network that is coupled between the upper power supply (VDD) and the lower power supply (VSS). The buffer circuit (X45) is coupled to the center tap of the voltage divider such that VCOM is half way between VDD and VSS, or VCOM=VSS+(VDD−VSS)/2. VCOMU is coupled to the top tap of the resistor divider such that VCOMU is half way between VCOM and VDD, or VCOMU=VCOM+(VDD−VCOM)/2. VCOML is coupled to the VCOM, or VCOML=VSS+(VCOM−VSS)/2. The buffer circuit is provided such that currents from the amplifier circuits (see FIGS. 2A, 3 and 4A) do not change the voltage associated with VCOM.

Voltage reference circuit 410 is an example of one possible voltage reference that may be employed by the various amplifier circuits. However, any other appropriate voltage reference circuit may be employed in place of the voltage reference circuit that is illustrated in FIG. 4B. Other example voltage references include band-gap based voltage references (see e.g., FIG. 3), and non band-gap based voltage references, to name a few.

The switching circuits employed in the various amplifier circuits can be any circuit that is arranged to provide a switching function. In one example, the switching circuits are field effect transistors (FETs) such as metal-oxide semiconductor (MOS) devices. However, the same circuit configuration is equally applicable for bipolar junction transistors (BJTs), as well as others. Other example circuits that perform the switching functions described above are considered within the scope of the present invention.

The amplifier and buffer circuits employed in FIGS. 2A through 4C can be any circuit that is arranged to provide an amplifier function, where the upper and lower amplifiers are matched in overall quiescent current. Each of the amplifier circuits is a differential amplifier that includes a differential pair input stage and an output stage that is arranged for charge sharing operation. In one example, the upper amplifier circuit has N-type transistors in the differential pair input stage and the lower amplifier circuit has P-type transistors. The transistors can be field effect transistors (FETs) such as metal-oxide semiconductor (MOS) devices. However, the same circuit configuration is equally applicable for bipolar junction transistors (BJTs), as well as others.

Figure 4C:
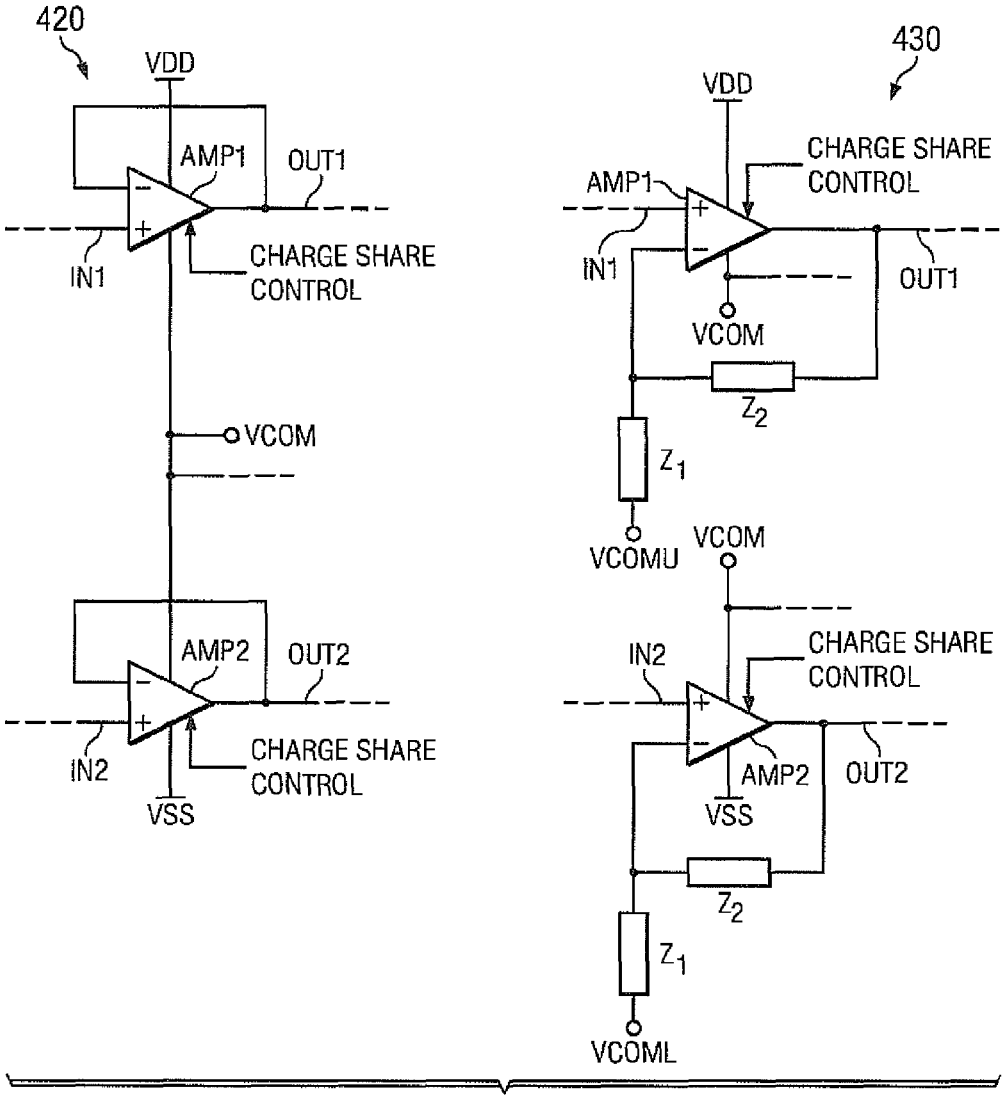
FIG. 4C is a schematic diagram of addition amplifier configurations for a stacked amplifier column driver circuit that is arranged in accordance with at least some aspect of the present invention.

Other example circuits that perform the amplifying/buffering functions described above are considered within the scope of the present invention. FIG. 4C is a schematic diagram that illustrates some addition example configurations for a stacked amplifier column driver circuit that is arranged in accordance with at least some aspect of the present invention. A first example configuration that is illustrated is for a buffer amplifier configuration (410), where the upper amplifier circuit (AMP1) and the lower amplifier circuit (AMP2) are arranged as a stacked amplifier that are responsive the charge share control signal for charge share operation. A second example configuration that is illustrated is for a non-inverting gain amplifier configuration (420), where the upper amplifier circuit (AMP1) and the lower amplifier circuit (AMP2) are arranged as a stacked amplifier that are responsive the charge share control signal for charge share operation, with the addition of a feedback network (Z1 and Z2) that is arranged to set the gain of the non-inverting amplifiers. The feedback networks used by the various amplifier configuration described herein may be passive or active components, including but not limited to resistors, capacitors, inductors, switched capacitors, and other components as will be understood by those of skill in the art.

Although the invention has been described herein by way of exemplary embodiments, variations in the structures and methods described herein may be made without departing from the spirit and scope of the invention. For example, the positioning of the various components may be varied. Individual components and arrangements of components may be substituted as known to the art. Since many embodiments of the invention can be made without departing from the spirit and scope of the invention, the invention is not limited except as by the appended claims.

What is claimed is:

1. A column driver circuit for a graphics display, comprising:

an upper amplifier circuit that includes an upper supply terminal arranged to be coupled to an upper power supply, a lower supply terminal coupled to a common node, and an output terminal coupled to a first node, wherein the upper amplifier circuit is arranged to couple the lower supply terminal to the output terminal via an output stage of the upper amplifier circuit during charge share operation of the upper amplifier circuit;

a lower amplifier circuit that includes an upper supply terminal coupled to the common node, a lower supply terminal arranged to be coupled to a lower power supply, and an output terminal coupled to a second node, wherein the lower amplifier circuit is arranged to couple the upper supply terminal to the output terminal via an output stage of the lower amplifier circuit during charge share operation of the lower amplifier circuit; and an output switching circuit that includes a first input coupled to the first node, a second input coupled to the second node, a first output coupled to a third node, and a second output coupled to a fourth node;

wherein the third node and the fourth node are arranged to be coupled to a first column line and a second column line of the graphics display, respectively;

wherein the output switching circuit is arranged to couple the first node and the second node to the third node and the fourth node; and wherein the upper amplifier circuit is responsive to a first charge share control signal and the lower amplifier circuit is responsive to a second charge share control signal that is inversely related to the first charge share control signal such that the charge share operations of the upper and lower amplifier circuits are activated via the first and second charge share control signals, respectively.

2. The column driver circuit of claim 1, wherein:

the output stage of the upper amplifier circuit comprises a p-type transistor and an n-type transistor that are arranged in a push-pull configuration coupled in common at the first node; and a first switching circuit is arranged to selectively activate the n-type transistor such that the common node is coupled to the first node through the n-type transistor during the charge share operation of the upper amplifier circuit.

3. The column driver circuit of claim 1, wherein:

the output stage of the lower amplifier circuit comprises a p-type transistor and an n-type transistor that are arranged in a push-pull configuration coupled in common at the second node; and a second switching circuit is arranged to selectively activate the p-type transistor such that the common node is coupled to the second node through the p-type transistor during the charge share operation of the lower amplifier circuit.

4. The column driver circuit of claim 1, wherein:

the output stage of the upper amplifier circuit comprises a first p-type transistor and a first n-type transistor that are arranged in a first push-pull configuration coupled in common at the first node;

the output stage of the lower amplifier circuit comprises a second p-type transistor and a second n-type transistor that are arranged in a second push-pull configuration coupled in common at the second node; and a first switching circuit and a second switching circuit are arranged to selectively activate a respective one of the first n-type transistor and the second p-type transistor such that the common node is coupled to the first node and the second node through the first n-type transistor and the second p-type transistor, respectively, during the charge share operations of the upper and lower amplifier circuits.

5. The column driver circuit of claim 1, wherein:

the output switching circuit is configured to couple the first node to the third node and the fourth node during the charge share operation of the upper amplifier circuit; and the output switching circuit is configured to couple the second node to the third node and the fourth node during the charge share operation of the lower amplifier circuit.

6. The column driver circuit of claim 1, wherein the output switching circuit comprises:

a first controlled switch coupled between the first node and the third node;

a second controlled switch coupled between the first node and the fourth node;

a third controlled switch coupled between the second node and the third node; and a fourth controlled switch coupled between the second node and the fourth node.

7. The column driver circuit of claim 1, further comprising:

a reference circuit arranged to provide a reference voltage to the common node.

8. The column driver circuit of claim 1, wherein each of the upper amplifier circuit and the lower amplifier circuit comprises a buffer amplifier.

9. The column driver circuit of claim 1, wherein:

the upper amplifier circuit comprises a first inverting amplifier configuration with a first gain determined by a first feedback network;

the lower amplifier circuit comprises a second inverting amplifier configuration with a second gain determined by a second feedback network;

the first inverting amplifier configuration is arranged to be referenced to an upper common voltage; and the second inverting amplifier configuration is arranged to be referenced to a lower common voltage.

10. An apparatus for driving a graphics display, comprising:

a control circuit arranged to assert first and second charge share control signals during charge share operations for the apparatus; and an array of column driver circuits that are each arranged to drive a respective pair of first and second column lines, wherein each column driver circuit comprises:

an upper amplifier circuit that includes an upper supply terminal coupled to an upper supply node, a lower supply terminal coupled to a common node, and a respective output terminal coupled to a respective first node, wherein the upper amplifier circuit is arranged such that the common node is coupled to the respective output terminal of the upper amplifier circuit when the first charge share control signal is asserted, wherein the common node is associated with a reference voltage;

a lower amplifier circuit that includes an upper supply terminal coupled to the common node, a lower supply terminal coupled to a lower supply node, and a respective output terminal coupled to a respective second node, wherein the lower amplifier circuit is arranged such that the common node is coupled to the respective output terminal of the lower amplifier circuit when the second charge share control signal is asserted, wherein the second charge share control signal is inversely related to the first charge share control signal; and an output switching circuit that is arranged to couple the output terminal of the upper amplifier circuit to the respective pair of first and second column lines when the first charge share control signal is asserted and to couple the output terminal of the lower amplifier circuit to the respective pair of first and second column lines when the second charge share control signal is asserted.

11. The apparatus of claim 10, wherein:

each upper amplifier circuit comprises a switching transistor, a p-type transistor, and an n-type transistor;

the p-type transistor and the n-type transistor are arranged in a push-pull configuration coupled in common to the respective output terminal of the upper amplifier circuit; and the switching transistor is arranged to selectively activate the n-type transistor when the first charge share control signal is asserted such that the common node is coupled to the respective output terminal of the upper amplifier circuit through the n-type transistor.

12. The apparatus of claim 10, wherein:

each lower amplifier circuit comprises a switching transistor, a p-type transistor, and an n-type transistor;

the p-type transistor and the n-type transistor are arranged in a push-pull configuration coupled in common to the respective output terminal of the lower amplifier circuit; and the switching transistor is arranged to selectively activate the p-type transistor when the second charge share control signal is asserted such that the common node is coupled to the respective output terminal of the lower amplifier circuit through the p-type transistor.

13. The apparatus of claim 10, wherein:

each upper amplifier circuit comprises a first switching transistor, a first p-type transistor, and a first n-type transistor;

each lower amplifier circuit comprises a second switching transistor, a second p-type transistor, and a second n-type transistor;

the first p-type transistor and the first n-type transistor are arranged in a first push-pull configuration coupled in common to the respective output terminal of the upper amplifier circuit;

the first switching transistor is arranged to selectively activate the first n-type transistor when the first charge share control signal is asserted such that the common node is coupled to the respective output terminal of the upper amplifier circuit through the first n-type transistor;

the second p-type transistor and the second n-type transistor are arranged in a second push-pull configuration coupled in common to the respective output terminal of the lower amplifier circuit; and the second switching transistor is arranged to selectively activate the second p-type transistor when the second charge share control signal is asserted such that the common node is coupled to the respective output terminal of the lower amplifier circuit through the second p-type transistor.

14. The apparatus of claim 10, wherein each output switching circuit comprises:

a first controlled switch coupled between the respective output terminal of the upper amplifier circuit and the first column line;

a second controlled switch coupled between the respective output terminal of the upper amplifier circuit and the second column line;

a third controlled switch coupled between the respective output terminal of the lower amplifier circuit and the first column line; and a fourth controlled switch coupled between the respective output terminal of the lower amplifier circuit and the second column line.

15. The apparatus of claim 10, wherein the reference voltage is temperature compensated.

16. The apparatus of claim 10, wherein each of the upper and lower amplifier circuits is arranged as a buffer amplifier.

17. The apparatus of claim 10, wherein:

each of the upper and lower amplifier circuits is arranged as an inverting gain amplifier;

each upper amplifier circuit is arranged to be referenced to an upper common voltage; and each lower amplifier circuit is arranged to be referenced to a lower common voltage.

18. An apparatus for driving a graphics display, comprising:

a control means arranged to assert first and second charge share control signals during charge share operations for the apparatus; and a column driver circuit that is arranged to drive a pair of first and second column lines, wherein the column driver circuit comprises:

an upper amplifier means that is arranged to be operated from an upper supply voltage and a reference voltage, wherein the upper amplifier means is arranged such that a common node is coupled to an output of the upper amplifier means when the first charge share control signal is asserted;

a lower amplifier means that is arranged to be operated from the reference voltage and a lower supply voltage, wherein the lower amplifier means is arranged such that the common node is coupled to an output of the upper amplifier means when the second charge share control signal is asserted, the second charge share control signal inversely related to the first charge share control signal; and an output switching means that is arranged to couple the output of the upper amplifier means to the first and second column lines when the first charge share control signal is asserted and to couple the output of the lower amplifier means to the first and second column lines when the second charge share control signal is asserted.

19. The apparatus of claim 18, wherein:

the upper amplifier means comprises a first switching transistor, a first p-type transistor, and a first n-type transistor;

the lower amplifier means comprises a second switching transistor, a second p-type transistor, and a second n-type transistor;

the first p-type transistor and the first n-type transistor are arranged in a first push-pull configuration coupled in common to the output of the upper amplifier means;

the first switching transistor is arranged to selectively activate the first n-type transistor when the first charge share control signal is asserted such that the common node is coupled to the output of the upper amplifier means through the first n-type transistor;

the second p-type transistor and the second n-type transistor are arranged in a second push-pull configuration coupled in common to the output of the lower amplifier means; and the second switching transistor is arranged to selectively activate the second p-type transistor when the second charge share control signal is asserted such that the common node is coupled to the output of the lower amplifier means through the second p-type transistor.

20. A circuit configured to drive column lines of a graphics display, wherein the circuit comprises:

a first amplifier circuit configured to be coupled to a first power supply, the first amplifier circuit also configured to couple a common node to an output of the first amplifier circuit when a first charge share control signal is asserted;

a second amplifier circuit configured to be coupled to a second power supply, the second amplifier circuit also configured to couple the common node to an output of the second amplifier circuit when a second charge share control signal is asserted, the second charge share control signal inversely related to the first charge share control signal; and an output switching circuit configured to couple the output of the first amplifier circuit to the column lines when the first charge share control signal is asserted and to couple the output of the second amplifier circuit to the column lines when the second charge share control signal is asserted;

wherein: the first amplifier circuit comprises a first switching transistor, a first p-type transistor, and a first n-type transistor;

The second amplifier circuit comprises a second switching transistor, a second p-type transistor, and a second n-type transistor;

The first p-type transistor and the first n-type transistor are arranged in a first push-pull configuration coupled in common to the output of the first amplifier circuit.

21. The circuit of claim 20, wherein:

the first switching transistor is configured to selectively activate the first n-type transistor when the first charge share control signal is asserted such that the common node is coupled to the output of the first amplifier circuit through the first n-type transistor;

the second p-type transistor and the second n-type transistor are arranged in a second push-pull configuration coupled in common to the output of the second amplifier circuit; and the second switching transistor is configured to selectively activate the second p-type transistor when the second charge share control signal is asserted such that the common node is coupled to the output of the second amplifier circuit through the second p-type transistor.

22. A circuit configured to drive column lines of a graphics display, wherein the circuit comprises:

a first amplifier circuit configured to be coupled to a first power supply, the first amplifier circuit also configured to couple a common node to an output of the first amplifier circuit;

a second amplifier circuit configured to be coupled to a second power supply, the second amplifier circuit also configured to couple the common node to an output of the second amplifier circuit; and an output switching circuit configured to couple the output of one of the first amplifier circuit and the second amplifier circuit to the column lines;

wherein the first amplifier circuit comprises (i) a switching transistor and (ii) a p-type transistor and an n-type transistor that are arranged in a push-pull configuration coupled in common at the output of the first amplifier circuit; and wherein the switching transistor is configured to selectively activate the n-type transistor such that the common node is coupled to the output of the first amplifier circuit through the n-type transistor.

23. A circuit configured to drive column lines of a graphics display, wherein the circuit comprises:

a first amplifier circuit configured to be coupled to a first power supply, the first amplifier circuit also configured to couple a common node to an output of the first amplifier circuit;

a second amplifier circuit configured to be coupled to a second power supply, the second amplifier circuit also configured to couple the common node to an output of the second amplifier circuit; and an output switching circuit configured to couple the output of one of the first amplifier circuit and the second amplifier circuit to the column lines;

wherein the second amplifier circuit comprises (i) a switching transistor and (ii) a p-type transistor and an n-type transistor that are arranged in a push-pull configuration coupled in common at the output of the second amplifier circuit; and wherein the switching transistor is configured to selectively activate the p-type transistor such that the common node is coupled to the output of the second amplifier circuit through the n-type transistor.

* * * * *